United States Patent [19]

Razbin et al.

[11] Patent Number: 4,817,540

[45] Date of Patent: Apr. 4, 1989

[54] SYSTEM FOR ASH REINJECTION IN BUBBLING-BED FLUIDIZED BED COMBUSTOR

[75] Inventors: Vladimir V. Razbin, Kanata; Dilip L. Desai, Nepean; Frank D. Friedrich, Carp, all of Canada

[73] Assignee: Energy, Mines & Resources Canada, Ottawa, Canada

[21] Appl. No.: 32,604

[22] Filed: Apr. 1, 1987

[30] Foreign Application Priority Data

Apr. 4, 1986 [CA] Canada ..... 505921

[51] Int. Cl.[4] ..... F23J 1/00

[52] U.S. Cl. ..... 110/266; 110/216; 110/245; 431/170; 122/4 D; 406/94; 406/195; 422/145

[58] Field of Search ..... 431/7, 170; 122/4 D; 110/216, 245, 266; 406/93, 94, 95, 191, 194, 195; 422/145

[56] References Cited

U.S. PATENT DOCUMENTS

| | | | |
|---|---|---|---|
| 1,294,730 | 2/1919 | Von Porat | 110/266 |
| 2,219,011 | 10/1940 | Kidwell et al. | 406/94 X |
| 2,881,133 | 4/1959 | Whiteley et al. | 406/94 X |
| 3,389,076 | 6/1968 | Oldweiler | 406/94 X |
| 3,537,755 | 11/1970 | Schmidt | 406/95 |
| 3,575,471 | 4/1971 | Meyer | 406/95 |
| 3,874,739 | 4/1975 | Mitchell | 406/195 X |
| 4,442,796 | 4/1984 | Strohmeyer | 122/4 D |

FOREIGN PATENT DOCUMENTS

| | | | |
|---|---|---|---|
| 539455 | 11/1931 | Fed. Rep. of Germany | 110/266 |
| 2605886 | 8/1976 | Fed. Rep. of Germany | 122/4 D |

*Primary Examiner*—Larry Jones
*Assistant Examiner*—Carl D. Price

[57] ABSTRACT

An improved reinjection system is described for a bubbling bed fluidized bed combustor of the type having a combustion zone in which fuel is burned in a fluidized bed of granular material, means for collecting particles from the flue gases and means for reinjecting the collected particles into the combustion zone. The improved reinjection system comprises a first particulate material conductor pipe sloping downwardly toward the combustion zone, the lower end of this first downwardly sloping pipe being flow connected by way of a lower corner or elbow to a short section of upwardly sloping pipe. The upper end of this short upwardly sloping pipe is flow connected by way of an upper corner or elbow to a second downwardly sloping pipe. The first downwardly sloping pipe, the upwardly sloping pipe and the second downwardly sloping pipe form therebetween a Z-valve. Air injector means are provided for injecting air into the upwardly sloping pipe to lift the particles therein over the upper corner and further air injector means are provided for forcing the particles from the second downwardly sloping pipe into the fluidized bed of the combustion zone against the back pressure of the bed.

1 Claim, 2 Drawing Sheets

SYSTEM FOR ASH REINJECTION IN BUBBLING-BED FLUIDIZED BED COMBUSTOR

This invention relates to a system for ash reinjection in a bubbling-bed fluidized bed combustor.

In fluidized bed combustion, fuel is burned in a bed of granular material which commonly includes limestone or dolomite to react with and thus effect capture of sulphur in the fuel. There is substantial elutriation of solids from the bed, such that the flue gas is laden with particulates consisting of fuel ash, unburned fuel, calcined sorbent and reaction products, such as $CaSO_4$.

It is standard practice to partially clean the flue gas by passing it through a mechanical collector, such as a multi-cyclone, and then reinject the collected solids into the fluidized bed combustor. Reinjection achieves a more complete combustion of the fuel and a more complete utilization of the sulphur sorbent.

The conventional technology for particulate reinjection into bubbling-bed fluidized bed combustors employs high-velocity pneumatic transport with pick up of the particulates accomplished either by an eductor system or a lockhopper system. With the eductor system, a medium-pressure air nozzle located at the bottom of the particulates hopper provides a stream of air which entrains the particulates and transports them through a pipe into the combustor against the back pressure of the fluidized bed. With the lockhopper system, two small conical lockhoppers, each sealed by a large disc valve at the top, are arranged in series below the particulates hopper. The lockhoppers can be pressurized by a medium-pressure air supply. The operating sequence is typically as follows:

1. The valve on the upper lockhopper opens, and the valve on the lower lockhopper closes. Particulates from the particulate hopper flow by gravity into the upper lockhopper.

2. The valve on the upper lockhopper closes and the valve on the lower lockhopper opens. The upper lockhopper is pressurized, forcing the particulates into the lower lockhopper.

3. The valve on the upper lockhopper opens and the valve on the lower lockhopper closes. While the upper lockhopper is being recharged with particulates, the lower lockhopper is pressurized, forcing its charge of particulates through a pipe into a combustor against the back pressure of the fluidized bed.

The above cycle is repeated every few seconds and the valving arrangements for sealing, venting and pressurizing the lockhoppers are very complex. It has been found that such systems suffer severe wear due to erosion by the high velocity streams of particulates. It has been necessary to frequently replace the disc valves and it has also been necessary to replace transport lines. A further disadvantage of the lockhopper system is that particulates are reinjected into the bed in short bursts, causing unstable combustion conditions.

It is the object of the present invention to overcome the above difficulties by means of a system having no moving parts and no high velocity movement of particulates.

SUMMARY OF THE INVENTION

This invention in its broadest aspect relates to an improved reinjection system for a bubbling bed fluidized bed combustor of the type having a combustion zone in which fuel is burned in a fluidized bed of granular material, means for collecting particles from the flue gases and means for reinjecting the collected particles into the combustion zone. The improved reinjection system comprises a first particulate material conductor pipe sloping downwardly toward the combustion zone, the lower end of this first downwardly sloping pipe being flow connected by way of a lower corner or elbow to a short section of upwardly sloping pipe. The upper end of this short upwardly sloping pipe is flow connected by way of an upper corner or elbow to a second downwardly sloping pipe. The first downwardly sloping pipe, the upwardly sloping pipe and the second downwardly sloping pipe form therebetween a Z-valve. Air injector means are provided for injecting air into the upwardly sloping pipe to lift the particles therein over the upper corner and further air injector means are provided for forcing the particles from the second downwardly sloping pipe into the combustion zone of the fluidized bed against the back pressure of the bed.

According to a preferred embodiment of the invention, the air injector means for lifting the particles up the upwardly sloping pipe and over the upper corner include an axially mounted air nozzle at the lower end of the upwardly sloping pipe which serves to pull the particles around the lower corner and further injector nozzles mounted in a lower region of the upwardly sloping pipe and directed to urge the particles within the pipe to move upwardly and over the upper corner.

According to another preferred embodiment, the air injector means for forcing the particles into the fluidized bed include a throat portion of reduced cross-sectional area with the outlet of an air injector nozzle mounted within the throat such as to provide an outwardly diverging air spray within the throat serving to draw the particles from the second downwardly sloping pipe into the fluidized bed against the back pressure of the fluidized bed.

One or more additional air nozzles may be also mounted in the first downwardly sloping pipe to encourage flow of the particles within the pipe particularly after flow has been stopped.

BRIEF DESCRIPTION OF THE DRAWINGS

The invention will now be explained more fully and by way of example with reference to the accompanying drawings wherein.

DETAILED DESCRIPTION OF THE PREFERRED EMBODIMENT

Figure 1:
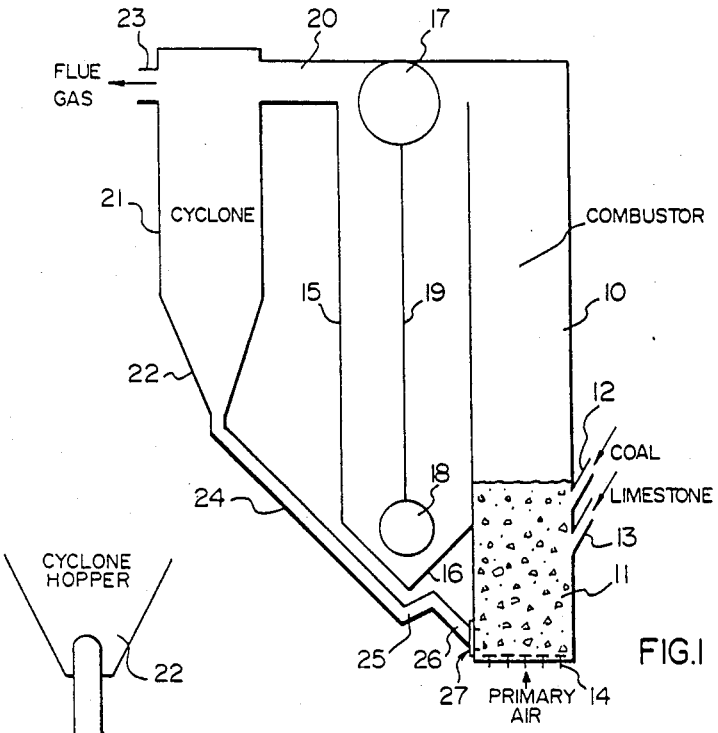
FIG. 1 is a diagrammatic sectional view showing a fluidized bed reactor and cyclone with the reinjection system of the present invention.

A fluidized bed combustor 10 has a combustion zone 11 containing granular material, including coal and limestone. Fresh coal and limestone are added by way of a coal feeder 12 and a limestone feeder 13. Combustion air is injected through an air distributor system 14 at the bottom of the combustion zone.

The top end of the combustor 10 is flow connected to a convection bank 15 having a hopper shaped lower end 16. Within the convection bank 15 are a steam drum 17, mud drum 18 and a baffle 19.

Hot gases from the combustor pass through the convection bank 15 and through duct 20 into a cyclone 21 where particulate material is separated from the flue gases. This particulate material is collected in hopper 22 while the flue gases exit through outlet 23.

Connected to the lower end of hopper 22 is a pipe 24. This pipe 24 is mounted typically at an angle of about 45° to the horizontal. At the lower end of pipe 24 is a "Z" valve which forms a seal against the static pressure of the fluidized bed by means of accumulation of particulate material. This "Z" valve includes an upwardly inclined pipe 25 connected to the lower end of pipe 24 and a downwardly inclined pipe 26 connected to the upper end of upwardly inclined pipe 25. The pipe 26 is typically inclined at an angle of about 45°, while the corners between the pipes are typically at an angle of about 105°. The lower end of pipe 26 connects to the fluidized bed by way of an injector port 27.

Figure 2:
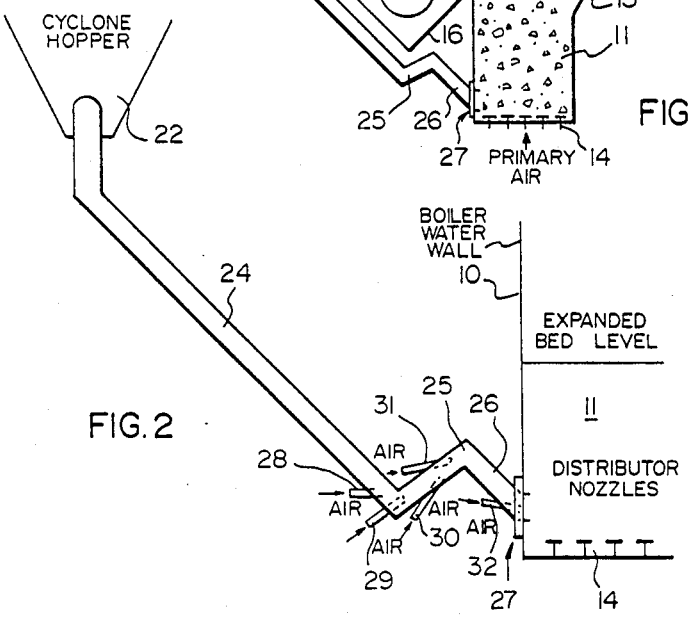
FIG. 2 is a diagrammatic sectional view of the reinjection system of the invention.
Figure 4:
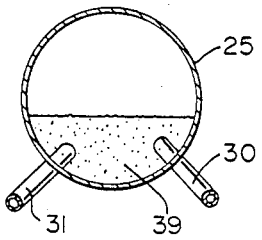
FIG. 4 is a diagrammatic sectional view of the upwardly sloping pipe with air injectors.

The particulate material flows by gravity from the cyclone hopper 22 down the inclined pipe 24 and is lifted over the "Z" valve by small amounts of air injected into the pipes. As will be seen from FIG. 2, at least one injection port 28 may be provided in a lower region of pipe 24 through which low velocity air may be bled to encourage flow of the particulate material down pipe 24 so as to reach the corner between pipe 24 and pipe 25. An air injection nozzle 29 is mounted through the wall of pipe 24 and axially of pipe 25 and projecting into the corner between the pipes. The air discharging from this nozzle tends to transfer the particulate material around the corner and upwardly into the pipe 25. Further injection nozzles 30 and 31 are mounted in a lower region of pipe 25 as can best be seen from FIG. 4 and a relatively small flow of air through these injection nozzles continues to urge the movement of the particulate material 39 up pipe 25 and over the corner between pipe 25 and pipe 26. At this point, the particulate material flows by gravity down pipe 26. In the absence of air flow through the air injectors, the "Z" valve forms a seal as described above.

Figure 3:
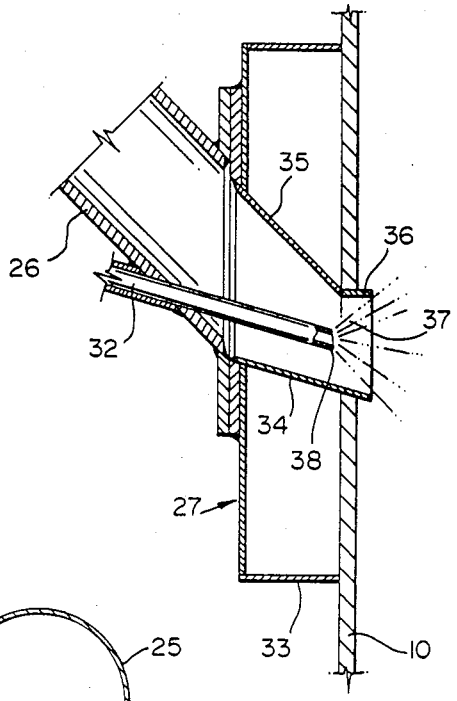
FIG. 3 is a sectional view of the particulate injector port into the fluidized bed.

As shown in FIG. 3, the lower end of pipe 26 connects to injector 27, this including a housing 33 holding an injection port of reducing cross-sectional area formed by walls 34 and 35. These converge to a throat section 37 of reduced cross-sectional area and a slightly outwardly flared end portion 36. Air injector tube 32 extends axially into the throat section 37 with the outer end 38 of tube 32 forming a nozzle which is set back a distance from the outer end of the throat section 37 whereby the air discharge from the air injector nozzle 38 flares outwardly to fill the injection opening and serves to draw the particulate material from pipe 26 into the fluidized bed.

It will be seen that with the exception of the reinjection nozzle, the entire system operates at low velocities with minimal potential for erosion. Furthermore, upon failure of air supply, the system is self-sealing and subsequently can be restarted without difficulty.

We claim:

1. In a bubbling bed fluidized bed combustor having a combustion zone in which fuel is burned in a fluidized bed of granular material, means for collecting particles from flue gases and means for reinjecting the collected particles into the combustion zone, an improved reinjection system comprising a particulate material conductor pipe connecting said particle collecting means to said combustion zone, said conductor pipe including a first downwardly sloping section flow connected at an upper end thereof to said particle collecting means, a short upwardly sloping section flow connected at a lower end thereof to a lower end of said first downwardly sloping section and a second downwardly sloping section flow connected at an upper end thereof to an upper end of said upwardly sloping section, the first downwardly sloping section, the upwardly sloping section and the second downwardly sloping section forming therebetween a Z-valve, first air injector means for injecting air into the upwardly sloping section to lift the particles therein past the upper end of said short upwardly sloping pipe section, said first injector means including an air nozzle mounted axially with respect to said short upwardly sloping pipe section, at the lower end of said upwardly sloping pipe section to draw particulate material from the first downwardly sloping section into the upwardly sloping section and additional air nozzles mounted in a lower region of said upwardly sloping section to direct air flows to urge the flow of particulate material up the upwardly slopping pipe section and a second air injector means for forcing particles from the second downwardly sloping section into the fluidized bed of the combustion zone against back pressure from the fluidized bed, said second air injector means including a tapered pipe portion forming a throat of reduced cross-sectional area and an air nozzle with an outlet in said throat adapted to create an air flow drawing particulate material from the second downwardly sloping section and force said particulate material into the fluidized bed against said back pressure.

* * * * *